US011959690B2

(12) United States Patent
LeRoy

(10) Patent No.: US 11,959,690 B2
(45) Date of Patent: Apr. 16, 2024

(54) THERMAL STORAGE DEVICE FOR CLIMATE CONTROL SYSTEM

(71) Applicant: Trane International Inc., Davidson, NC (US)

(72) Inventor: Jason T. LeRoy, Tyler, TX (US)

(73) Assignee: Trane International Inc., Davidson, NC (US)

( * ) Notice: Subject to any disclaimer, the term of this patent is extended or adjusted under 35 U.S.C. 154(b) by 41 days.

(21) Appl. No.: 17/554,515

(22) Filed: Dec. 17, 2021

(65) Prior Publication Data

US 2023/0194143 A1 Jun. 22, 2023

(51) Int. Cl.

| | |
|---|---|
| ***F25B 13/00*** | (2006.01) |
| ***F25B 49/02*** | (2006.01) |
| ***F25D 21/00*** | (2006.01) |
| ***F28D 9/00*** | (2006.01) |

(52) U.S. Cl.

CPC ..... *F25D 21/002* (2013.01); *F25B 13/00* (2013.01); *F25B 49/02* (2013.01); *F28D 9/0031* (2013.01)

(58) Field of Classification Search

CPC ..... F25D 21/002; F25B 13/00; F25B 49/02; F28D 9/0031

See application file for complete search history.

(56) References Cited

U.S. PATENT DOCUMENTS

| | | | |
|---|---|---|---|
| 4,646,537 | A | 3/1987 | Crawford |
| 4,646,539 | A | 3/1987 | Taylor |
| 4,720,980 | A | 1/1988 | Howland |
| 5,052,191 | A | 10/1991 | Shapiro-Baruch |
| 5,269,151 | A | 12/1993 | Dinh |
| 8,516,837 | B2 | 8/2013 | Swarup et al. |
| 9,842,978 | B1 | 12/2017 | Salvador et al. |

(Continued)

FOREIGN PATENT DOCUMENTS

| | | | |
|---|---|---|---|
| EP | 3 244 141 | A1 | 11/2017 |
| WO | WO 1997/041398 | A1 | 11/1997 |

(Continued)

OTHER PUBLICATIONS

Oota, Air Conditioner, 2012, Full Document (Year: 2012).*

Amari, Heat Storage Device . . . , 2019, Full Documetn (Year: 2019).*

*Primary Examiner* — Nael N Babaa

(74) *Attorney, Agent, or Firm* — WOMBLE BOND DICKINSON (US) LLP

(57) ABSTRACT

A heat pump includes a compressor, a metering device, a first heat exchanger, a second heat exchanger, a first fan, a second fan, and a refrigerant circuit between the first heat exchanger and the second heat exchanger. A thermal storage device coupled to the refrigerant circuit is configured to store thermal energy when the refrigerant fluid is above a threshold temperature and discharge thermal energy when the refrigerant fluid is below the threshold temperature. The heat pump is operated in a heating mode in which heat is transferred from the refrigerant fluid at the first heat exchanger and the temperature of the refrigerant fluid at the thermal storage device is above the threshold temperature, and a defrost mode in which heat is transferred to the refrigerant fluid at the first heat exchanger and the temperature of the refrigerant fluid at the thermal storage device is below the threshold temperature.

20 Claims, 9 Drawing Sheets

(56) References Cited

U.S. PATENT DOCUMENTS

| | | | | |
|---|---|---|---|---|
| 10,082,325 | B2 | 9/2018 | Saito et al. | |
| 10,907,879 | B2 | 2/2021 | Lavrich | |
| 2013/0312437 | A1 | 11/2013 | Davies et al. | |
| 2014/0130532 | A1 | 5/2014 | Chen | |
| 2014/0245770 | A1* | 9/2014 | Chen | F25B 29/003 62/238.7 |
| 2016/0161162 | A1 | 6/2016 | Saito et al. | |
| 2020/0049392 | A1 | 2/2020 | Tanaka | |

FOREIGN PATENT DOCUMENTS

| | | | | |
|---|---|---|---|---|
| WO | WO-2013088684 | A1 * | 6/2013 | F24F 5/00 |
| WO | WO 2016/181105 | A1 | 11/2016 | |
| WO | WO-2020158941 | A1 * | 8/2020 | |

* cited by examiner

THERMAL STORAGE DEVICE FOR CLIMATE CONTROL SYSTEM

TECHNOLOGICAL FIELD

The present disclosure relates generally to using a thermal storage device in a climate control system for improving defrost operations and efficacy, and this device may be utilized with new or existing systems.

BACKGROUND

Climate control systems, e.g., HVAC systems, are commonly provided in residential, commercial, and industrial environments, in order to control one or more environmental factors of a designated space in which desired conditions for people, goods, equipment, etc., are to be provided. Such environmental factors can include, for example, air temperature, humidity, etc.

Some HVAC systems use a split system heat pump that employs a compressor, an outdoor unit including an outdoor heat exchanger, and an indoor unit including an indoor heat exchanger, and associated components. Such HVAC systems can include a refrigerant circuit that runs between the indoor unit and the outdoor unit to take advantage of the material properties of a selected refrigerant to selectively absorb or discharge heat at the heat exchangers to achieve desired conditions for the designated/conditioned space.

These systems can be configured to run in a variety of modes depending on the desired effect to be achieved in the designated/conditioned space. For example, in a cooling mode, a compressor can provide compressed, high temperature refrigerant fluid to the heat exchanger of the outdoor unit in which heat is discharged to the outdoor environment, and the lower energy refrigerant fluid can then be circulated to the heat exchanger at the indoor unit to absorb heat to cool the designated/conditioned space.

In a heating mode, the compressor can provide the compressed, high temperature refrigerant fluid to the heat exchanger of the indoor unit such that heat is discharged to the designated/conditioned space to provide a desired level of heating. The lower energy refrigerant fluid can then be circulated to the heat exchanger at the outdoor unit to absorb heat from the outdoor environment before returning to the compressor.

In heating modes such as those described above, and especially in the cold climates in which a heating mode of an HVAC system is often employed, drawing heat in from the already cold surrounding environment proximate the outdoor unit can cause moisture present in the air or on surfaces to freeze, crystallize, etc. such that ice and frost can form on components of the outdoor unit.

HVAC systems are sometimes provided with a defrost mode to address the buildup of ice and frost on components proximate an outdoor unit such as in the conditions described above. The defrost mode of such HVAC systems can often run similarly to the cooling mode described above, so that heat is discharged from the refrigerant fluid at the heat exchanger of the outdoor unit in order to melt/thaw or otherwise warm components associated with the outdoor unit.

However, in addition to the discharge of heat from the refrigerant fluid at the heat exchanger of the outdoor unit, the defrost mode of HVAC systems can also result in heat being absorbed by the refrigerant fluid from the designated/conditioned space at the heat exchanger of the indoor unit, resulting in a cooling effect that can be undesirable in cold climates. Accordingly, some HVAC systems incorporate additional or auxiliary heating units to counteract the cooling effect on the designated/conditioned space associated with running the system in a defrost mode. However, the inclusion of such auxiliary heating units can contribute to energy losses, system complexity, etc.

It would therefore be desirable to have a system and method that takes into account at least some of the issues discussed above, as well as other possible issues.

BRIEF SUMMARY

Example implementations of the present disclosure provide an HVAC system or heat pump including a compressor that circulates refrigerant fluid in a refrigerant circuit between a first or indoor heat exchanger and a second or outdoor heat exchanger. The HVAC system or heat pump thereof can include associated sensors and metering devices to monitor and/or alter the flow of refrigerant fluid through the refrigerant circuit. A first or indoor fan can be positioned adjacent the first heat exchanger, and a second or outdoor fan can be positioned adjacent the second heat exchanger. Each fan can be configured to be selectively driven to produce an airflow.

Control circuity can be provided to operate the system/heat pump in a plurality of modes that can include a heating mode, a cooling mode, and a defrost mode with different operational parameters.

In the heating mode, the compressor can circulate the refrigerant fluid to the indoor heat exchanger to transfer heat to a surrounding environment, e.g., an indoor or conditioned space, and to the outdoor heat exchanger to absorb heat from the surrounding outdoor environment.

The defrost mode can operate differently than the heating mode, with the compressor circulating the refrigerant fluid to the outdoor heat exchanger to discharge/release heat to the outdoor environment, and to the indoor heat exchanger, which can cause heat to be absorbed from the indoor/conditioned space. The defrost mode may be run in order to provide heating to components of the system/heat pump that are located in an outdoor environment that may be cold.

Systems and heat pumps according to the present disclosure can also be provided with one or more thermal storage devices that are configured to selectively absorb/retain and discharge/release heat in order to enhance and facilitate operations of the system/heat pump. Such thermal storage devices can be configured to absorb heat from the refrigerant fluid during the heating mode of the system/heat pump when the refrigerant fluid is above a threshold temperature, and to discharge/release heat to the refrigerant fluid in the defrost mode when the refrigerant fluid is below a threshold temperature.

The present disclosure thus includes, without limitation, the following example implementations.

Some example implementations provide a heat pump comprising: a compressor, a metering device, a first heat exchanger, and a second heat exchanger; a refrigerant circuit comprising a refrigerant fluid that circulates between the first heat exchanger and the second heat exchanger; a first fan configured to produce an airflow, the first fan positioned adjacent the first heat exchanger; a second fan configured to produce an airflow, the second fan positioned adjacent the second heat exchanger; a thermal storage device coupled to the refrigerant circuit such that the refrigerant fluid flows therethrough, the thermal storage device configured to store thermal energy when the refrigerant fluid flowing therethrough is above a threshold temperature and discharge thermal energy when the refrigerant fluid flowing therethrough is below the threshold temperature; and control circuitry, wherein the control circuitry is configured to: operate the heat pump in a plurality of modes, the plurality of modes comprising a heating mode and a defrost mode, wherein in the heating mode the compressor circulates the refrigerant fluid such that heat is transferred from the refrigerant fluid at the first heat exchanger and heat is transferred to the refrigerant fluid at the second heat exchanger, and the temperature of the refrigerant fluid at the thermal storage device is above the threshold temperature such that heat from the refrigerant fluid is stored in the thermal energy device; wherein in the defrost mode the compressor circulates the refrigerant fluid such that heat is transferred to the refrigerant fluid at the first heat exchanger and heat is transferred from the refrigerant fluid at the second heat exchanger, and the temperature of the refrigerant fluid at the thermal storage device is below the threshold temperature such that heat from the thermal energy device is discharged to the refrigerant fluid.

Some example implementations provide a method of operating a climate control system comprising: a compressor, a metering device, a first heat exchanger, a second heat exchanger, a first fan positioned adjacent the first heat exchanger, and a second fan positioned adjacent the second heat exchanger a refrigerant circuit comprising a refrigerant fluid that circulates between the first heat exchanger and the second heat exchanger, a thermal storage device fluidly coupled to the refrigerant circuit and configured to store thermal energy when refrigerant fluid flowing therethrough is above a threshold temperature and discharge thermal energy when refrigerant fluid flowing therethrough is below the threshold temperature, and a controller; the method comprising: operating the climate control system in a heating mode, wherein in the heating mode the compressor circulates the refrigerant fluid such that heat is transferred from the refrigerant fluid at the first heat exchanger and heat is transferred to the refrigerant fluid at the second heat exchanger, and the temperature of the refrigerant fluid at the thermal storage device is above the threshold temperature such that heat from the refrigerant fluid is stored in the thermal energy device; and operating the climate control system in a defrost mode, wherein in the defrost mode the compressor circulates the refrigerant fluid such that heat is transferred to the refrigerant fluid at the first heat exchanger and heat is transferred from the refrigerant fluid at the second heat exchanger, and the temperature of the refrigerant fluid at the thermal storage device is below the threshold temperature such that heat from the thermal energy device is discharged to the refrigerant fluid.

These and other features, aspects, and advantages of the present disclosure will be apparent from a reading of the following detailed description together with the accompanying figures, which are briefly described below. The present disclosure includes any combination of two, three, four or more features or elements set forth in this disclosure, regardless of whether such features or elements are expressly combined or otherwise recited in a specific example implementation described herein. This disclosure is intended to be read holistically such that any separable features or elements of the disclosure, in any of its aspects and example implementations, should be viewed as combinable unless the context of the disclosure clearly dictates otherwise.

It will therefore be appreciated that this Brief Summary is provided merely for purposes of summarizing some example implementations so as to provide a basic understanding of some aspects of the disclosure. Accordingly, it will be appreciated that the above described example implementations are merely examples and should not be construed to narrow the scope or spirit of the disclosure in any way. Other example implementations, aspects and advantages will become apparent from the following detailed description taken in conjunction with the accompanying figures which illustrate, by way of example, the principles of some described example implementations.

BRIEF DESCRIPTION OF THE FIGURE(S)

Having thus described example implementations of the disclosure in general terms, reference will now be made to the accompanying figures, which are not necessarily drawn to scale, and wherein:

DETAILED DESCRIPTION

Figure 1:
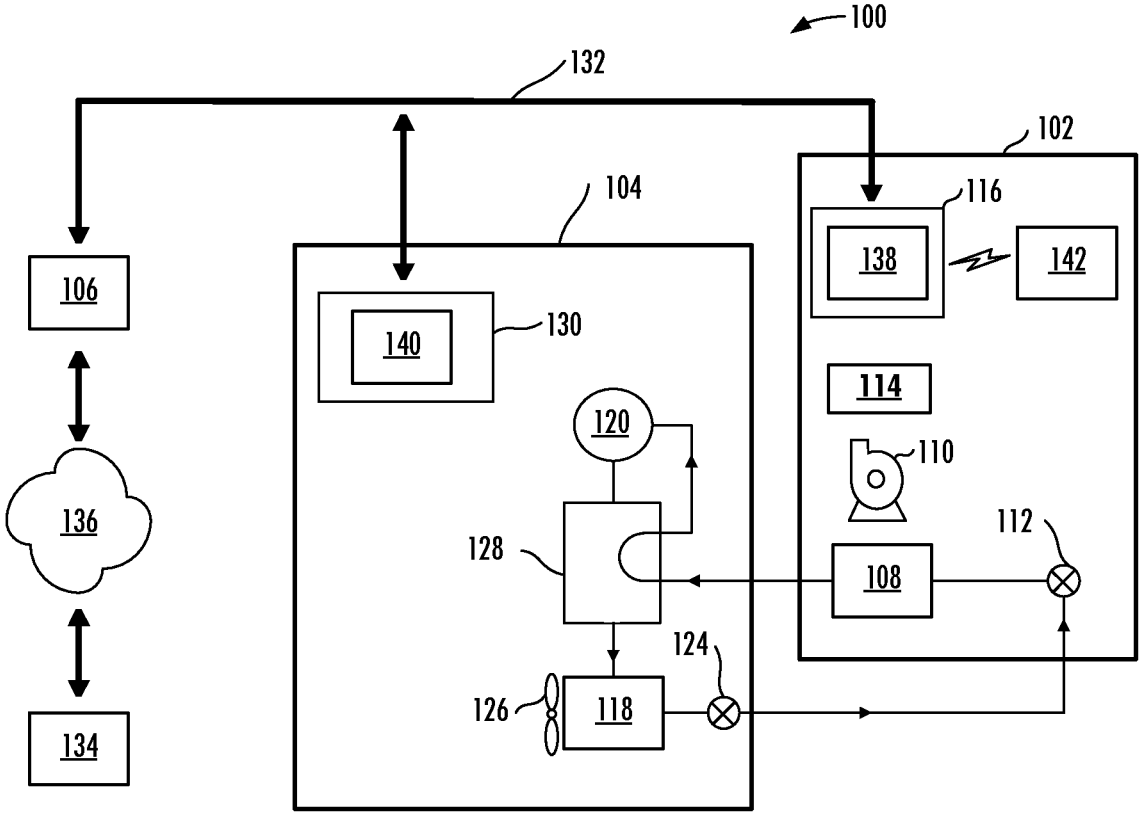
FIG. 1 is a schematic of an HVAC system, according to an example embodiment of the present disclosure.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," "observation" and similar terms may be at times used interchangeably.

Example implementations of the present disclosure can be directed to an HVAC system or heat pump that includes a compressor for pressurizing a refrigerant fluid, a metering device for selectively adjusting one or more properties of the refrigerant fluid (e.g., pressure), a first heat exchanger configured to transfer heat between the refrigerant fluid and a surrounding airflow, a second heat exchanger configured to transfer heat between the refrigerant fluid and a surrounding airflow, a first fan configured to produce an airflow and positioned adjacent the first heat exchanger, and a second fan configured to produce an airflow and positioned adjacent the second heat exchanger.

The present disclosure is also directed to a thermal storage device that can be coupled to the refrigerant circuit for absorbing/retaining heat from the refrigerant fluid and/or discharging/releasing energy to the refrigerant fluid. In some constructions, the thermal storage device includes a phase change material configured to store thermal energy when the refrigerant fluid is above a threshold temperature and discharge thermal energy when the refrigerant fluid is below the threshold temperature.

Heat pumps/systems of the present disclosure can be provided with control circuitry configured to operate the heat pump in a plurality of modes that can include a heating mode, and a defrost mode.

In a heating mode, the compressor can circulate the refrigerant fluid such that heat is transferred from the refrigerant fluid at the first heat exchanger to heat a surrounding space and heat is transferred to the refrigerant fluid at the second heat exchanger to cool the surrounding space. In such constructions, and the temperature of the refrigerant fluid at the thermal storage device is above the threshold temperature such that heat from the refrigerant fluid is stored in the thermal energy device in the heating mode.

In the defrost mode, the compressor can circulate the refrigerant fluid such that heat is transferred to the refrigerant fluid at the first heat exchanger to cool a surrounding space and heat is transferred from the refrigerant fluid at the second heat exchanger to heat the surrounding space. In such arrangements, the temperature of the refrigerant fluid at the thermal storage device is below the threshold temperature such that heat from the thermal energy device is discharged to the refrigerant fluid in the defrost mode.

FIG. 1 shows a schematic diagram of a typical climate control system 100. In some embodiments, the climate control system 100 comprises a heat pump system that may be selectively operated to implement one or more substantially closed thermodynamic refrigerant cycles to provide a cooling functionality (hereinafter a "cooling mode") and/or a heating functionality (hereinafter a "heating mode"). The embodiment depicted in FIG. 1 is configured in a cooling mode. The climate control system 100, in some embodiments, is configured as a split system heat pump system, and generally comprises an indoor unit 102, an outdoor unit 104, and a system controller 106 that may generally control operation of the indoor unit 102 and/or the outdoor unit 104. The climate control system may also be configured as a packaged unit where the components of the indoor unit and the outdoor unit are included within a single unit. Other configurations are also contemplated within the scope of this disclosure.

Indoor unit 102 generally may comprise one or more of the following: an indoor air handling unit comprising an indoor heat exchanger 108, an indoor fan 110, an indoor metering device 112, a reheat unit 114, and an indoor controller 116. The indoor heat exchanger 108 may generally be configured to promote heat exchange between a refrigerant carried within internal tubing of the indoor heat exchanger 108 and an airflow that may contact the indoor heat exchanger 108 but that is segregated from the refrigerant.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device.

The auxiliary heating unit 114 may comprise a heating element, potentially a gas or electric heating element. In some embodiments, the auxiliary heating unit 114 can heat an airflow to provide heating to a conditioned space. In some embodiments, the auxiliary heating unit 114 operates during defrost mode to reheat an airflow after it has been passed through the indoor heat exchanger 108 in the defrost mode.

Outdoor unit 104 generally comprises an outdoor heat exchanger 118, a compressor 120, an outdoor fan 126, an outdoor metering device 124, a switch over valve 128, and an outdoor controller 130. The outdoor heat exchanger 118 may generally be configured to promote heat transfer between a refrigerant carried within internal passages of the outdoor heat exchanger 118 and an airflow that contacts the outdoor heat exchanger 118 but is segregated from the refrigerant.

The outdoor metering device 124 may generally comprise a thermostatic expansion valve. In some embodiments, however, the outdoor metering device 124 may comprise an electronically-controlled motor driven EEV similar to indoor metering device 112, a capillary tube assembly, and/or any other suitable metering device.

In some embodiments, the switch over valve 128 may generally comprise a four-way reversing valve. The switch over valve 128 may also comprise an electrical solenoid, relay, and/or other device configured to selectively move a component of the switch over valve 128 between operational positions to alter the flow path of refrigerant through the switch over valve 128 and consequently the climate control system 100. Additionally, the switch over valve 128 may also be selectively controlled by the system controller 106, an outdoor controller 130, and/or the indoor controller 116.

The system controller 106 may generally be configured to selectively communicate with the indoor controller 116 of the indoor unit 102, the outdoor controller 130 of the outdoor unit 104, and/or other components of the climate control system 100. In some embodiments, the system controller 106 may be configured to control operation of the indoor unit 102, and/or the outdoor unit 104. In some embodiments, the system controller 106 may be configured to monitor and/or communicate with a plurality of temperature sensors associated with components of the indoor unit 102, the outdoor unit 104, and/or the outdoor ambient temperature. Additionally, in some embodiments, the system controller 106 may comprise a temperature sensor and/or may further be configured to control heating and/or cooling of conditioned spaces or zones associated with the climate control system 100. In other embodiments, the system controller 106 may be configured as a thermostat for controlling the supply of conditioned air to zones associated with the HVAC system 100, and in some embodiments, the thermostat includes a temperature sensor.

The system controller 106 may also generally comprise an input/output (I/O) unit (e.g., a graphical user interface, a touchscreen interface, or the like) for displaying information and for receiving user inputs. The system controller 106 may display information related to the operation of the climate control system 100 and may receive user inputs related to operation of the climate control system 100. However, the system controller 106 may further be operable to display information and receive user inputs tangentially related and/or unrelated to operation of the climate control system 100. In some embodiments, the system controller 106 may not comprise a display and may derive all information from inputs that come from remote sensors and remote configuration tools.

In some embodiments, the system controller 106 may be configured for selective bidirectional communication over a communication bus 132, which may utilize any type of communication network (e.g., a controller area network (CAN) messaging, etc.). In some embodiments, portions of the communication bus 132 may comprise a three-wire connection suitable for communicating messages between the system controller 106 and one or more of the components of the climate control system 100 configured for interfacing with the communication bus 132. Still further, the system controller 106 may be configured to selectively communicate with components of the climate control system 100 and/or any other device 134 via a communication network 136. In some embodiments, the communication network 136 may comprise a telephone network, and the other device 134 may comprise a telephone. In some embodiments, the communication network 136 may comprise the Internet, and the other device 134 may comprise a smartphone and/or other Internet-enabled mobile telecommunication device.

The indoor controller 116 may be carried by the indoor unit 102 and may generally be configured to receive information inputs, transmit information outputs, and/or otherwise communicate with the system controller 106, the outdoor controller 130, and/or any other device 134 via the communication bus 132 and/or any other suitable medium of communication. In some embodiments, the indoor controller 116 may be configured to communicate with an indoor personality module 138 that may comprise information related to the identification and/or operation of the indoor unit 102.

The indoor EEV controller 142 may be configured to receive information regarding temperatures and/or pressures of the refrigerant in the indoor unit 102. More specifically, the indoor EEV controller 142 may be configured to receive information regarding temperatures and pressures of refrigerant entering, exiting, and/or within the indoor heat exchanger 108.

The outdoor controller 130 may be carried by the outdoor unit 104 and may be configured to receive information inputs, transmit information outputs, and/or otherwise communicate with the system controller 106, the indoor controller 116, and/or any other device 134 via the communication bus 132 and/or any other suitable medium of communication. In some embodiments, the outdoor controller 130 may be configured to communicate with an outdoor personality module 140 that may comprise information related to the identification and/or operation of the outdoor unit 104. In some embodiments, the outdoor controller 130 may be configured to receive information related to an ambient temperature associated with the outdoor unit 104, information related to a temperature of the outdoor heat exchanger 118, and/or information related to refrigerant temperatures and/or pressures of refrigerant entering, exiting, and/or within the outdoor heat exchanger 118 and/or the compressor 120.

Figure 2A:
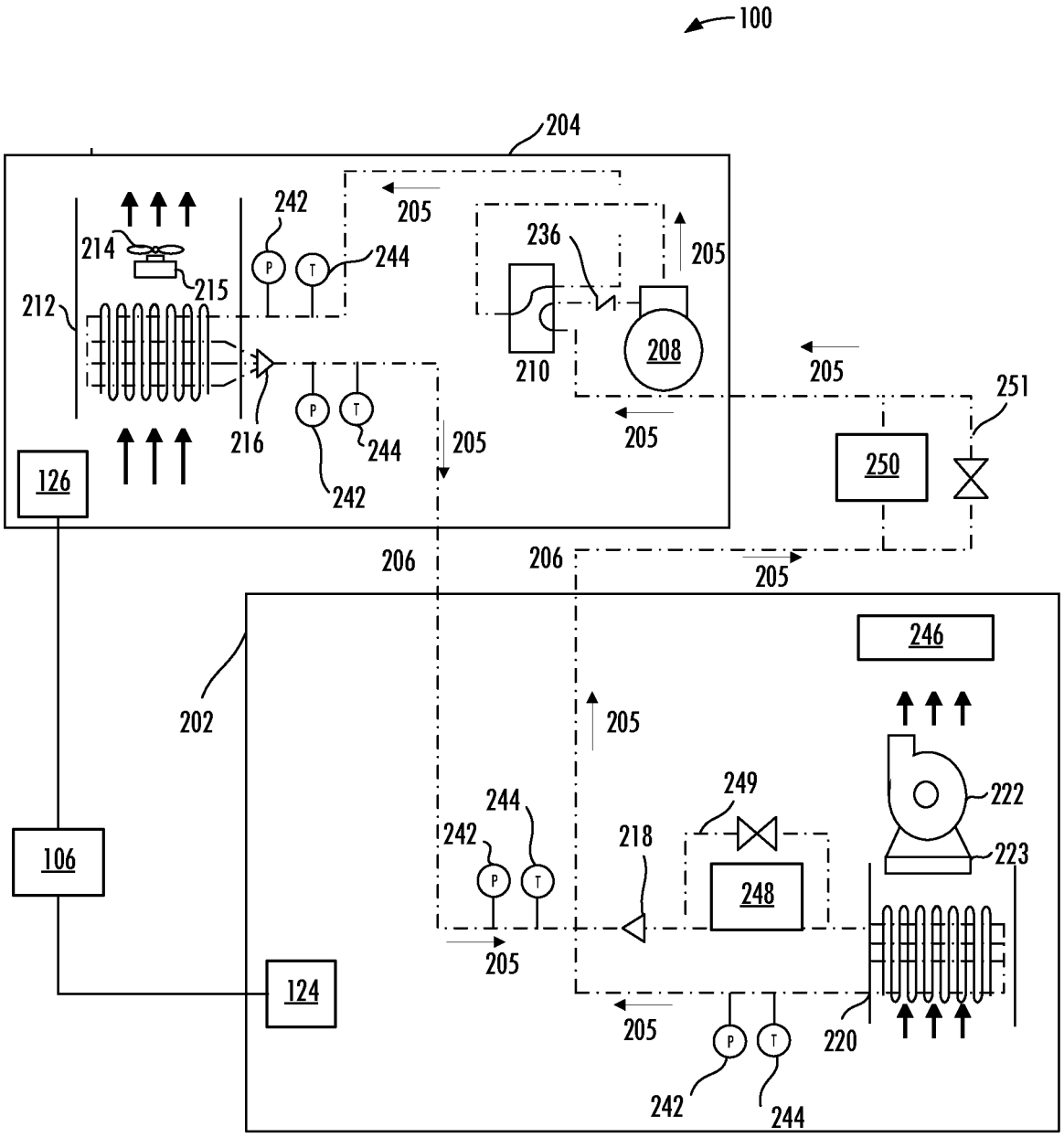
FIG. 2A is a schematic of a cooling mode refrigerant cycle of the system of FIG. 1 and including a thermal storage device, according to an example embodiment of the present disclosure.
Figure 2B:
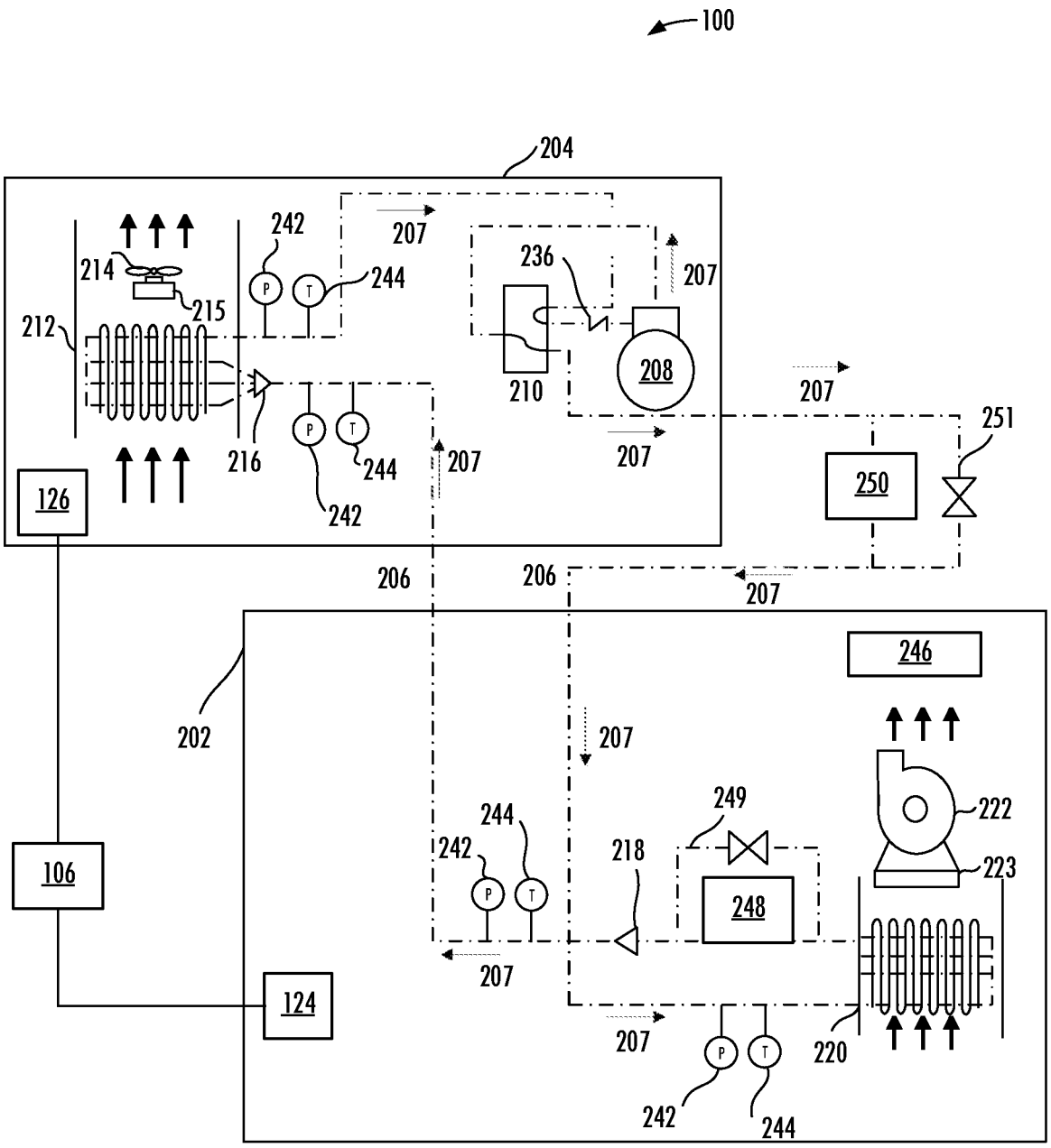
FIG. 2B is a schematic of a heating mode refrigerant cycle of the system of FIG. 1 with a thermal storage device, according to an example embodiment of the present disclosure.
Figure 2C:
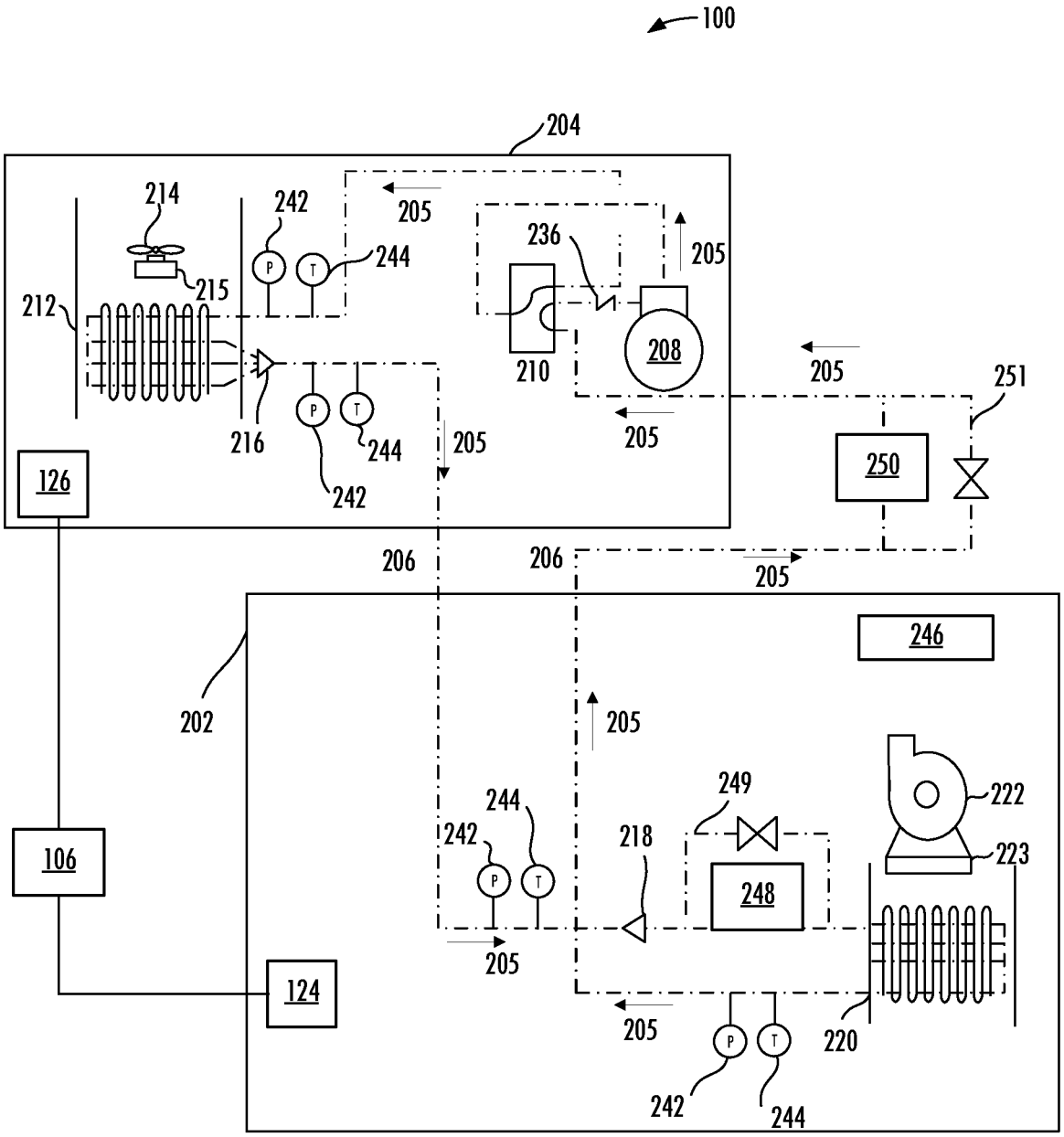
FIG. 2C is a schematic of a defrost mode refrigerant cycle of the system of FIG. 1 with a thermal storage device, according to an example embodiment of the present disclosure.

As discussed above, the HVAC system 100 may operate in a plurality of modes. These modes include a heating mode, a cooling mode, and a defrost mode. FIGS. 2A, 2B, and 2C provide a more detailed illustration of the modes, e.g., FIG. 2A (cooling mode), FIG. 2B (heating mode), FIG. 2C (defrost mode), and some of the components that may be used in these modes, including the thermal storage device(s), as described further herein.

As discussed below, in the depicted embodiment the climate control system 100 includes an indoor unit 202 and an outdoor unit 204, where the refrigerant fluid circulates through a refrigerant circuit 206 between the indoor unit 202 having an indoor heat exchanger 220 (broadly, "first heat exchanger") and the outdoor unit 204 having an outdoor heat exchanger 212 (broadly, "second heat exchanger"), and while the refrigerant fluid circulates it may go through various phase changes in these cycles. For example, in some embodiments the refrigerant changes between a liquid, a mixed fluid comprising a liquid and a gas, and a gas.

In some embodiments, one or both of the indoor unit 202 and the outdoor unit 204 can comprise a respective enclosure, e.g., a housing unit, cabinet, etc., extending at least partially around the components thereof. In the configurations of the system 100 illustrated in FIGS. 2A, 2B, and 2C, the schematic borders associated with the respective indoor unit 202 and outdoor unit 204 can represent such respective enclosures.

Turning to FIG. 2A, an example schematic of a cooling mode of the system 100 is shown. In the depicted embodiment, the direction the refrigerant fluid travels in this refrigerant circuit 206 is indicated by arrows 205. Starting at the compressor 208 in FIG. 2A, compressor 208 may compress the refrigerant fluid and pump a relatively high temperature and high pressure compressed refrigerant fluid through the switch over valve 210 and to the outdoor heat exchanger 212. In some embodiments, the refrigerant fluid is a gas when discharged from compressor 208 in the cooling mode. At the heat exchanger 212 the refrigerant fluid may transfer heat to an airflow that is passed over, through and/or into contact with the outdoor heat exchanger 212 by the outdoor fan 214 (broadly, "second fan"), which can be driven by a motor 215 to which the fan 214 is operably coupled. During this process, the refrigerant fluid may undergo a phase change and/or temperature change. In one embodiment, the refrigerant fluid is in a liquid state after passing through the outdoor heat exchanger 212.

The aforementioned passage of the refrigerant fluid through the outdoor heat exchanger 212 results in the release of heat from refrigerant fluid of the system 100 to the surrounding environment, e.g., in the proximity of the outdoor unit 204. Such an effect of operating the system 100 in the cooling mode can be utilized in the defrost mode, as described further herein.

After exiting the outdoor heat exchanger 212, the refrigerant fluid may flow through the outdoor metering device 216, such that refrigerant fluid is not substantially restricted by the outdoor metering device 216. The refrigerant fluid generally exits the outdoor metering device 216 and flows to the indoor metering device 218, which may meter the flow of the refrigerant fluid through the indoor metering device 218, such that the refrigerant fluid downstream of the indoor metering device 218 is at a lower pressure than the refrigerant fluid upstream of the indoor metering device 218. During this process, the refrigerant fluid may undergo a phase change and/or temperature change. In some embodiments, the indoor metering device 218 changes the state of the refrigerant fluid in the cooling cycle to a mixed state that comprises a liquid and gas mixture. In some embodiments, the mixed fluid is predominately a gas, and in others, the mixed fluid is predominately a liquid.

From the indoor metering device 218, the refrigerant fluid may enter the indoor heat exchanger 220. As the refrigerant fluid is passed through the indoor heat exchanger 220, heat may be transferred to the refrigerant fluid from an airflow that is passed over, through and/or into contact with the indoor heat exchanger 220 by an indoor circulation fan 222 (broadly, "first fan") which can be driven by a motor 223 to which the fan 222 is operably coupled. During this process, the refrigerant fluid may undergo a phase change and/or temperature change. In some embodiments, the refrigerant fluid is in a gas state after passing through the indoor heat exchanger 220 in the cooling mode. The refrigerant fluid leaving the indoor heat exchanger 220 may flow to the switch over valve 210, where the switch over valve 210 may be selectively configured to divert the refrigerant back to the compressor 208, where the refrigerant fluid may begin a new cycle.

References herein to relative temperatures and pressures of the refrigerant fluid in the refrigerant circuit 206 can be monitored via one or more sensors in communication with the refrigerant circuit 206. In the illustrated embodiment, a pressure sensor 242 and a temperature sensor 244 can be provided along the refrigerant circuit at positions upstream and downstream of each of the indoor heat exchanger 218 and the outdoor heat exchanger 220 in order to measure the temperature and pressure of refrigerant fluid entering and exiting these components of the system 100. Such sensors can be analog components, e.g., electromechanical components, thermocouples, digital sensors, etc., or combinations thereof. It will be understood that a different number and arrangement of sensors could be provided without departing from the disclosure.

Turning to FIG. 2B, an example schematic of a heating mode of the system 100 is shown. In the depicted embodiment, the direction of travel of the refrigerant fluid is indicated by arrows 207. The heating mode of the system 100 can begin at the compressor 208, which circulates the refrigerant fluid through the refrigerant circuit 206. As shown in FIG. 2B, compressor 208 may compress the refrigerant fluid and pump a relatively high temperature and high pressure compressed refrigerant through the switch over valve 210 and to the indoor heat exchanger 220. In some embodiments, the refrigerant fluid is a gas when discharged from compressor 208 in the heating mode. At the indoor heat exchanger 220, the refrigerant fluid may transfer heat to an airflow that is passed through and/or into contact with the indoor heat exchanger 220 by the indoor fan 222 driven by the motor 223. During this process, the refrigerant fluid may undergo a phase change and/or temperature change. In one embodiment, the refrigerant fluid is in a liquid state after passing through the indoor heat exchanger 220 in the heating mode.

In some embodiments, an auxiliary heating unit 246, potentially a gas or electric heating element to produce heat independently of the action of the refrigerant circuit 206, can be activated to supplement heat discharged from the indoor heat exchanger 220, for example, in instances in which the system 100 is switching between modes and/or approaching a steady state of operation.

After exiting the indoor heat exchanger 220, the refrigerant fluid may flow through an indoor metering device 218, such that refrigerant fluid is not substantially restricted by the indoor metering device 218. The refrigerant fluid generally exits the indoor metering device 218 and flows to an outdoor metering device 216, which may meter the flow of the refrigerant through the outdoor metering device 216, such that the refrigerant fluid downstream of the outdoor metering device 216 is at a lower pressure than the refrigerant upstream of the outdoor metering device 216. During this process, the refrigerant fluid may undergo a phase change and/or temperature change. In one embodiment, the outdoor metering device 216 changes the state of the refrigerant fluid in the heating circuit to a mixed state that comprises a liquid and gas mixture. In some embodiments, the mixed fluid is predominately a liquid, and in others, the mixed fluid is predominately a gas.

From the outdoor metering device 216, the refrigerant may enter an outdoor heat exchanger 212. As the refrigerant is passed through the outdoor heat exchanger 212, heat may be transferred to the refrigerant from an airflow that is passed through and/or into contact with the outdoor heat exchanger 212 by the outdoor fan 214 driven by the motor 215. During this process, the refrigerant may undergo a phase change and/or temperature change. In one embodiment, the refrigerant is in a gas state after passing through the outdoor heat exchanger 212 in the heating mode.

The aforementioned passage of the refrigerant fluid through the outdoor heat exchanger 212 results the absorption of heat by the refrigerant fluid from the surrounding environment. Because the heating mode is typically being operated in cold climates/seasons, e.g., where the outdoor heat exchanger 212 is located, drawing heat in from the already cold surrounding environment can cause moisture present in the air or on surfaces to freeze, crystallize, etc. such that ice/frost can form on components of the outdoor unit 204. Such effect of running the system 100 in the heating mode can be addressed with the defrost mode, as described further herein.

The refrigerant leaving the outdoor heat exchanger 212 may flow to a switch over valve 210, where the switch over valve 210 may be selectively configured to divert the refrigerant back to the compressor 208, where the refrigerant cycle may begin again.

Turning to FIG. 2C, an example schematic of a defrost mode of the system 100 is shown. As described above, the defrost mode may be called for in order to address frost/ice buildup on one or more components associated with the outdoor unit 204 or other components of the system 100 that are positioned in an outdoor/cold weather climate. As described with respect to the heating mode above, heat can be transferred from the environment surrounding the outdoor unit 204 to the refrigerant fluid at the outdoor heat exchanger 212 such that ice/frost can form on one or more surfaces of the outdoor heat exchanger 212.

In this regard, and as described further herein, the defrost mode can be at least partially similar to the cooling mode described above, in that heat is intended to be transferred by the refrigerant fluid from the indoor heat exchanger 220 to the outdoor heat exchanger 212. However, in the defrost mode, the heat transferred to the outdoor heat exchanger 212 is used to melt or thaw ice/frost that has accumulated on the outdoor heat exchanger 212. In some embodiments, the defrost mode of the system 100 can be periodically employed during prolonged operation of the heating mode, e.g., to counteract ice/frost formed in the course of operating the system 100 in the heating mode.

In the depicted embodiment of the defrost mode of the system 100, the compressor 208 can circulate refrigerant fluid through the refrigerant circuit 206 in a direction indicated by the arrows 205. As described above, the compressor 208 can compress the refrigerant fluid and pump a relatively high temperature and high pressure compressed refrigerant fluid through the switch over valve 210 and the outdoor heat exchanger 212 for heat transfer with an airflow produced by the outdoor fan 214 as described above. During this process, the refrigerant fluid may undergo a phase change and/or temperature change, e.g., a change from a gaseous state to a liquid state after passing through the outdoor heat exchanger 212. As shown, the outdoor fan 214 and accompanying motor 215 can be deactivated in the defrost mode.

The aforementioned passage of the refrigerant fluid through the outdoor heat exchanger 212 results the release of heat from refrigerant fluid of the system 100 to the surrounding environment, e.g., the fins of the outdoor heat exchanger 212. Accordingly, the heat released at the outdoor heat exchanger 212 can be used to melt/thaw ice and/or frost that has accumulated on components of the system 100, namely the outdoor heat exchanger 212 itself.

After exiting the outdoor heat exchanger 212, the refrigerant fluid may flow substantially unrestricted through the outdoor metering device 216 and into the indoor metering device 218, with the indoor metering device 218 metering the flow or the refrigerant fluid so as to exit the metering device 218 at a lower pressure, e.g., so as to be in a mixed state comprising a liquid/gas mixture. In some embodiments, the lower pressure refrigerant fluid exiting the metering device 218 can be predominately a gas, and in others, the mixed fluid can be predominately a liquid.

From the indoor metering device 218, the refrigerant fluid may enter the indoor heat exchanger 220. Heat may be transferred to the refrigerant fluid from air that is in contact with the indoor heat exchanger 220. During this process, the refrigerant fluid may undergo a phase change and/or temperature change, e.g., so as to be in a gas state after passing through the indoor heat exchanger 220 as heat is absorbed from the air.

In this regard, running an HVAC system in a defrost mode can have the potential for the undesirable effect of cooling air in an indoor/conditioned space in cold weather conditions.

However, the system 100 of the present disclosure provides one or more thermal energy storage devices or thermal storage devices (TSDs) that are operable to selectively retain and discharge heat associated with the refrigerant circuit 206 to reduce or eliminate undesired cooling effects on an indoor/conditioned space when performing a defrost cycle. As described further herein, the thermal storage devices are configured to absorb and store thermal energy associated with relatively high energy states of the refrigerant fluid in the system 100, and to selectively discharge energy to the refrigerant fluid in the system 100 when the refrigerant fluid is in relatively low energy states.

As shown in FIGS. 2A-2C, a thermal storage device according to one exemplary implementation of the present disclosure is generally designated 248, and can be positioned in the refrigerant circuit 206 between the metering device 218 and the indoor heat exchanger 220 such that the refrigerant fluid flows therethrough. In some constructions, the thermal storage device 248 can be a first thermal storage device 248 of the system 100, and a second thermal storage device 250 can be provided in the refrigerant circuit 206 between the indoor heat exchanger 220 and the compressor 208. The thermal storage device 250 can be positioned outside enclosures associated with the respective indoor unit 202 and outdoor unit 204, as shown. It will be understood that one or both of the thermal storage devices 248, 250 can be provided in a different arrangement without departing from the disclosure.

Figure 3:
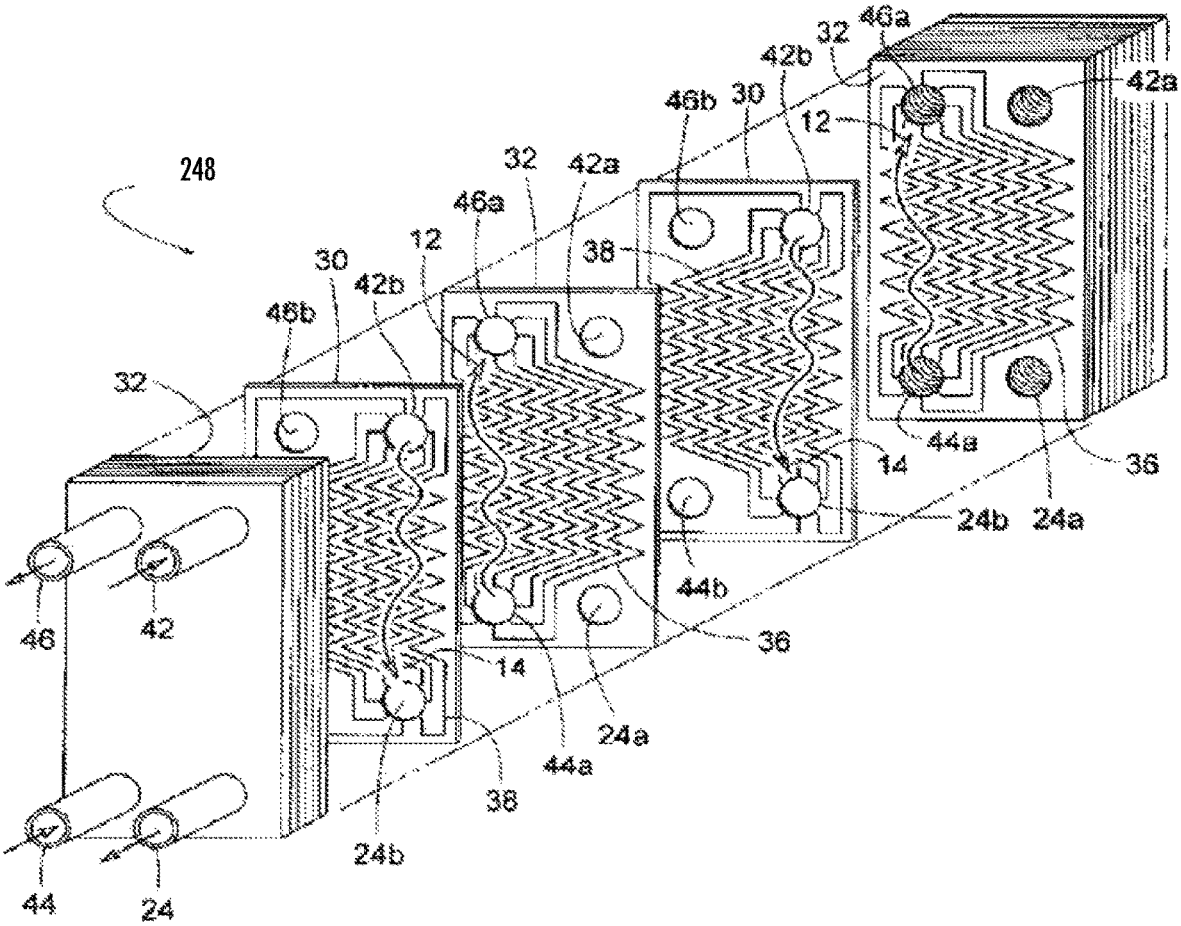
FIG. 3 is a parts-separated view of a thermal storage device, according to an example embodiment of the present disclosure.

Turning to FIG. 3, one construction of the thermal storage device 248 is illustrated. As described herein, the thermal storage device 248 can be configured to support, e.g., by holding in an interior portion thereof and/or via attachment to one or more portions thereof, a quantity of a phase change material.

The phase change material may generally be a substance with a relatively high heat of fusion, i.e., heat absorbed from a surrounding environment as the phase change material transitions from a solid to a liquid state. Correspondingly, the heat of solidification, e.g., heat emitted from the phase change material as it transitions from a liquid state to a solid state, is generally equal to the heat of fusion. In this regard, the phase change material can be selected with properties so as to absorb and store heat when exposed to substances/heat sources having an energy greater than the heat of fusion of the phase change material, and to release heat to environments in which less than the heat of fusion is present.

As shown, the thermal storage device 248 can have the form of a brazed plate heat exchanger having a plurality of corrugated conductive plates 30 and 32 disposed along substantially parallel planes (e.g., plurality of first and second planes) and being stacked in an alternating arrangement. In some examples, plates 30 and 32 are made of stainless steel sheet metal clad or otherwise coated with a thin layer of braze material (e.g., copper or copper alloy) that provides a joining interface of braze material at contact points between adjacent plates 30 and 32. For assembly, plates 30 and 32 are temporarily clamped together and heated to permanently braze plates 30 and 32 together to create alternating layers of a plurality of first passages 36 and a plurality of second passages 38 between adjacent plates 30 and 32. The brazing operation hermetically isolates the first passages 38 from the second passages 36 and hermetically seals an outer peripheral edge of plates 30 and 32.

The actual design of plates 30 and 32 may vary to provide numerous other heat exchanger configurations with any number of passes and flow patterns. For clear illustration, thermal storage device 248 is shown having one each of a first inlet 44, first outlet 46, a second inlet 42 and a second outlet 24. Each plate 32 includes a first supply opening 44*a*, a first return opening 46*a*, a second supply opening 42*a* and a second return opening 24*a*. Likewise, each plate 30 includes a first supply opening 44*b*, a first return opening 46*b*, a second supply opening 42*b* and a second return opening 24*b*.

A first fluid 12 can enter the device through the first inlet 44 and flow through first supply openings 44*a* and 44*b*. The openings 44*a* deliver the first fluid 12 to fluid passages 36, which convey the fluid in a zigzag and/or otherwise convoluted pattern between adjacent plates 30 and 32 to the first return openings 46*a*. Openings 46*a* and 46*b* then direct the first fluid to outlet 46 to allow the first fluid to continue along the refrigerant circuit 206 to which the thermal storage device 248 is fluidly coupled.

In some thermal storage devices, a second fluid or material 14 can enter through inlet 42 to flow through second supply openings 42*a* and 42*b*. In this regard, the openings 42*b* can deliver the second material 14 to the second passages 38, which convey the second material 14 in a zigzag and/or otherwise convoluted pattern between other adjacent plates 30 and 32 to the second return openings 24*b*. As the second material 14 is deposited through the passages 38, the first fluid 12 in adjacent passages 36 is arranged to either absorb heat from or discharge heat to the second material 14 through the adjacent conductive plates 30, 32, depending on the relative thermal energy states of the first fluid 12 and the second material 14. After such thermal exchange in the thermal storage device 248, openings 24*a* and 24*b* can direct the second material 14 to second outlet 24 for further delivery to a system.

However, in the illustrated embodiment, the first fluid 12 can be the refrigerant in the refrigerant circuit 206, and the second material 14 can be the phase change material, which can be injected to at least partially fill the passages 38, e.g., so that up to about half of the interior volume of the thermal storage device can be filled with the phase change material. In this regard, the inlet 42 and the outlet 24 can be sealed or plugged once the phase change material is deposited in the passages 38 of the thermal storage device 248. In some embodiments, the passages in which the refrigerant fluid and the phase change material are disposed can be reversed. In some embodiments, the phase change material can be disposed along selected portions of the passages 38.

In some embodiments, the configuration of the thermal storage device 248 can be selected based upon known or desired parameters.

In one example, the volume of phase change material ($V_{PCM}$) needed to be filled into the thermal storage device 248 can be determined by the following formula, wherein $M_{PCM}$=the mass of the phase change material, $\rho_{PCM}$=the density of the phase change material in the thermal storage device 248 in a liquid phase:

$$V_{PCM}=M_{PCM}/\rho_{PCM}.$$

As another example, the relationship among the $V_{PCM}$, the size and number of the conductive plates 30, 32 in the thermal storage device 248, and the overall dimensions of the thermal storage device 248 can be as follows, wherein D=the distance between edges of adjacent plates 30, 32, L=the length of the thermal storage device 248, W=the width of the thermal storage device 248, H=the depth of the thermal storage device 248, and N=the number of plates 30, 32 in the thermal storage device 248:

$$V_{PCM}=L\times W\times H\times N.$$

The thermal storage device 250 can have a similar configuration to that described above with regard to the thermal storage device 248, though can be filled with a different phase change material as described further below. It will be understood that one or both of the thermal storage devices 248, 250 can have a different configuration without departing from the disclosure.

In some embodiments, the thermal storage devices are sized based on one or more parameters of the climate control system 100. For example, the thermal storage devices 248, 250 may be selected based on the capacity size of the climate control system 100, and potentially, a desired time over which thermal energy can be discharged therefrom in the defrost mode of the system 100. The capacity size of the climate control system 100 may provide an indication of the cooling capacity of the system in a defrost mode along with the power input from a compressor during that mode. Accordingly, the thermal storage device 248 may be sized to include a thermal output that is proportional to the cooling capacity over a given period of time to account for a given amount of frost or ice that can build up on the outdoor heat exchanger 212 while the system 100 is operating in the cooling mode.

In this regard, the thermal storage devices 248, 250 are configured to store thermal energy when the refrigerant fluid of the refrigerant circuit 206 is above a threshold energy condition while passing through the respective thermal storage devices 248, 250 and to release/discharge thermal energy when the refrigerant fluid is below the respective threshold energy condition while passing through the respective thermal storage devices 248, 250. The threshold energy condition associated with the phase change material of the thermal storage devices can be a temperature of the respective phase change material, such that when the refrigerant fluid is above the respective threshold temperature, the thermal storage devices 248, 250 are configured to absorb and store thermal energy from the refrigerant fluid, and when the refrigerant fluid is below the respective threshold temperature the thermal storage devices 250 are configured to release/discharge thermal energy to the refrigerant fluid. It will be understood that the energy associated with the refrigerant fluid in the system 100 can depend on factors such as the temperature and pressure thereof, and the phase change materials can be selected based on these considerations.

In some embodiments, the threshold temperature associated with the phase change material in the thermal storage device 248 can be a temperature below about 80° F., for example, about 75° F. In some embodiments, the threshold temperature associated with the thermal storage device 248 can be between about 65° F. and about 80° F.

In some embodiments, the threshold temperature associated with the phase change material in the thermal storage device 250 can be a temperature between about 100° F. and about 120° F., for example, about 110° F. It will be understood that different threshold temperatures can be associated with the phase change material of one or both of the thermal storage devices 248, 250 without departing from the disclosure.

Referring once again to FIG. 2B, in the heating mode of the system 100, the thermal storage device 250 can also be positioned such that the inlet 44 thereof receives compressed refrigerant fluid exiting the compressor 208 and switch over valve 210, which flows through the passages 36 of the thermal storage device 250 (in parallel to the phase change material disposed along the passages 38), and exits the outlet 46 toward indoor heat exchanger 220.

In such an arrangement, the refrigerant fluid exiting the compressor 208 and switch over valve 210 can have a temperature greater than the threshold temperature associated with the phase change material in the thermal storage device 250 such that the phase change material absorbs and stores heats from the refrigerant fluid as it moves through the passages 36 of the thermal storage device 250. In some embodiments, the temperature of the refrigerant fluid prior to entering the thermal storage device 250 in the heating mode can be between about 120° F. and about 150° F. The absorption of heat from the refrigerant fluid by the phase change material in the thermal storage device 250 can involve a change in phase in at least a portion of the phase change material from a solid to a liquid state.

The thermal storage device 248 can also be arranged with an inlet 44 that receives refrigerant fluid exiting the indoor heat exchanger 220, which flows through the passages 36 of the thermal storage device 248 (in parallel to the phase change material disposed along the passages 38), and exits the outlet 46 toward the outdoor metering device 218.

In such an arrangement, the refrigerant fluid exiting the indoor heat exchanger 220 can have a temperature greater than the threshold temperature associated with the phase change material in the thermal storage device 248 such that the phase change material 248 absorbs and stores heat from the refrigerant fluid as it moves through the passages 36 of the thermal storage device 248. In some embodiments, the temperature of the refrigerant fluid entering the thermal storage device 248 can be between about 80° F. and 90° F. in the heating mode. The absorption of heat from the refrigerant fluid by the phase change material in the thermal storage device 248 can involve a change in phase in at least a portion of the phase change material from a solid to a liquid state.

The heating mode of the system 100 can proceed as described above, e.g. with refrigerant fluid exiting the second thermal storage device 248 and moving toward the outdoor heat exchanger 212 and, ultimately, the compressor 208 for further cycles through the refrigerant circuit 206.

Operation of the system 100 in the heating mode as described above, e.g., with the thermal storage devices 248, 250 arranged along the refrigerant circuit 206 such that the phase change materials absorb and store heat from the refrigerant fluid flowing therethrough, can be a considered a charging mode or state of the system 100.

Referring to FIG. 2C, the defrost mode of the system 100 can use energy stored in one or both of the thermal storage devices 248, 250 from operating the system 100 in the heating mode as described above to beneficial effect. In the defrost mode, refrigerant fluid in the refrigerant circuit 206 flows in the direction of the arrows 205, and the refrigerant fluid exiting the outdoor heat exchanger 212 and metering devices 216, 218 can have a temperature lower than the threshold temperature associated with the phase change material in the thermal storage device 248 such that the phase change material discharges heat to the refrigerant fluid as it moves through the passages 36 of the thermal storage device 248. The absorption of heat by the refrigerant fluid from the phase change material in the thermal storage device can involve a change in phase in at least a portion of the phase change material from a liquid state to a solid state.

Due to the thermal energy added to the refrigerant fluid by the thermal storage device 248, heat transfer from the environment surrounding the indoor heat exchanger 220 can be minimized, inhibited, reduced, prevented, etc. In some embodiments, heat stored within the structure of the indoor heat exchanger 220, e.g., heat retained in the pipes, fins, housing, etc. associated with the indoor heat exchanger from a previous heating mode, can be absorbed by the refrigerant fluid passing through the indoor heat exchanger 220.

Unlike the cooling mode described above, the refrigerant fluid is passed through the indoor heat exchanger 220 in the defrost mode substantially without being subject to an airflow that is passed over, through and/or into contact with the indoor heat exchanger 220. In this regard, the motor 223 and indoor fan 222 can be turned off/deactivated while the system 100 is in the defrost mode. In some embodiments, the indoor heat exchanger 220 can be at least partially isolated/compartmentalized from other airflows, e.g., via the closing of one or more doors/vents/apertures associated with a housing surrounding the indoor heat exchanger 220.

Similarly, the second thermal storage device 250 can be provided between the indoor heat exchanger 220 and the compressor 208, as described above, such that refrigerant fluid exiting the indoor heat exchanger 220 can flow through the passages 36 of the thermal storage device 250 (in parallel to the phase change material disposed along the passages 38), and exit the thermal storage device 250 toward the compressor 208.

In such an arrangement, the refrigerant fluid exiting the indoor heat exchanger 220 can have a temperature lower than the threshold temperature associated with the phase change material in the thermal storage device 250 such that the phase change material discharges heat to the refrigerant fluid as it moves through the passages 36 of the thermal storage device 250. The absorption of heat by the refrigerant fluid from the phase change material can involve a change in phase in at least a portion of the phase change material from a liquid state to a solid state.

In this regard, the thermal storage device 250 can discharge heat to the refrigerant fluid exiting the indoor heat exchanger 220 so as to supplement or augment the thermal energy discharged to the refrigerant fluid by the thermal storage device 248 as described above.

Accordingly, because the thermal storage device 248 adds thermal energy to the refrigerant prior to entering the indoor heat exchanger 220 and the thermal storage device 250 adds thermal energy to the refrigerant fluid after exiting the indoor heat exchanger 220, the amount of heat to be absorbed by the refrigerant fluid from the indoor/conditioned space is reduced or eliminated, and, further, because the indoor fan 222 can be deactivated in the defrost mode, a need for auxiliary heat to counteract unwanted cooling of the indoor/conditioned spaced in the defrost mode can be obviated. In this regard, the auxiliary heating unit 246 can be deactivated during the defrost mode, and the energy and/or time associated with the use of the auxiliary heating unit 246 can be reduced or eliminated. In some embodiments, the thermal storage devices 248, 250 can be configured to obviate the need for an auxiliary heating unit 246 in the system 100 entirely.

It will be understood that either or both of the thermal storage devices 248, 250 can be provided in the system 100 without departing from the disclosure. Accordingly, the thermal storage devices 248, 250 can operate synergistically to minimize, reduce, obviate, etc, the production of cold air surrounding the indoor heat exchanger 220 and/or the energy to operate the reheat unit 246. In some embodiments, a selected one of the thermal storage devices 248, 250 can be provided in the system 100 as described above. In other embodiments, a different arrangement of thermal energy storage devices can be provided in the system 100.

The defrost mode of the system 100 can proceed as described above, e.g. with refrigerant fluid exiting the thermal storage device 250 moving toward the compressor 208 for subsequent passages through the refrigerant circuit 206.

With momentary reference to FIG. 2A, it will be understood that the cooling mode of the system 100 can proceed as previously described with one or both of the thermal storage devices 248, 250. Such operation of the system 100 in the cooling mode can include circulating the refrigerant fluid through the thermal storage device 248 prior to entering the indoor heat exchanger and circulating the refrigerant fluid through the thermal storage device 250 after exiting the indoor heat exchanger 220. In the cooling mode, heat exchange between the phase change materials in the thermal storage devices 248, 250 and the refrigerant fluid flowing therethrough can be negligible. In some embodiments, the thermal storage devices 248, 250 can be circumvented at a respective bypass path 249, 251.

It will be understood that the control circuitry may be configured to control the one or more portions of the system 100 based on a set of parameters. For example, in some embodiments, the metering device 218 may be controlled, in part, to achieve and/or maintain a desired superheated condition of the refrigerant fluid in the refrigerant circuit 206. Such superheated condition of the refrigerant fluid can include a higher energy state than that required to evaporate into a gaseous condition, and can be measured, for example at the point where the refrigerant is discharged from the indoor heat exchanger 220. In these embodiments, the metering device 218 may be controlled to maintain a constant superheat level and/or maintain the refrigerant within a given range of superheat. In these embodiments, the superheat may be determined using temperature sensors 244 and/or pressure sensors 242.

FIGS. 4A-4G are flowcharts illustrating various steps in a method 300 of operating a climate control system, the climate control system comprising a compressor, a metering device, a first heat exchanger, a second heat exchanger, a first fan positioned adjacent the first heat exchanger, and a second fan positioned adjacent the second heat exchanger; a refrigerant circuit comprising a refrigerant fluid that circulates between the first heat exchanger and the second heat exchanger; a thermal storage device fluidly coupled to the refrigerant circuit and configured to store thermal energy when refrigerant fluid flowing therethrough is above a threshold temperature and discharge thermal energy when refrigerant fluid flowing therethrough is below the threshold temperature; and a controller. The method includes operating the climate control system in a heating mode, wherein in the heating mode the compressor circulates the refrigerant fluid such that heat is transferred from the refrigerant fluid at the first heat exchanger and heat is transferred to the refrigerant fluid at the second heat exchanger, and the temperature of the refrigerant fluid at the thermal storage device is above the threshold temperature such that heat from the refrigerant fluid is stored in the thermal energy device, as shown at block 302. The method further includes operating the climate control system in a defrost mode, wherein in the defrost mode the compressor circulates the refrigerant fluid such that heat is transferred to the refrigerant fluid at the first heat exchanger and heat is transferred from the refrigerant fluid at the second heat exchanger, and the temperature of the refrigerant fluid at the thermal storage device is below the threshold temperature such that heat from the thermal energy device is discharged to the refrigerant fluid, as shown at block 304.

Figure 4A:
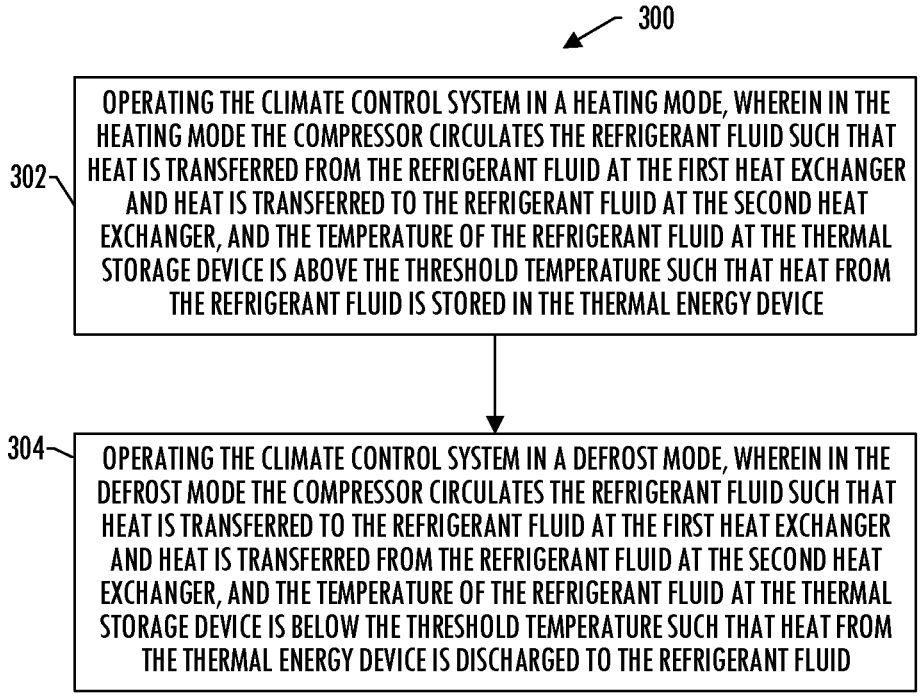
FIGS. 4A-4G are flowcharts illustrating various operations in a method of operating a climate control system, according to some example implementations.
Figure 4B:
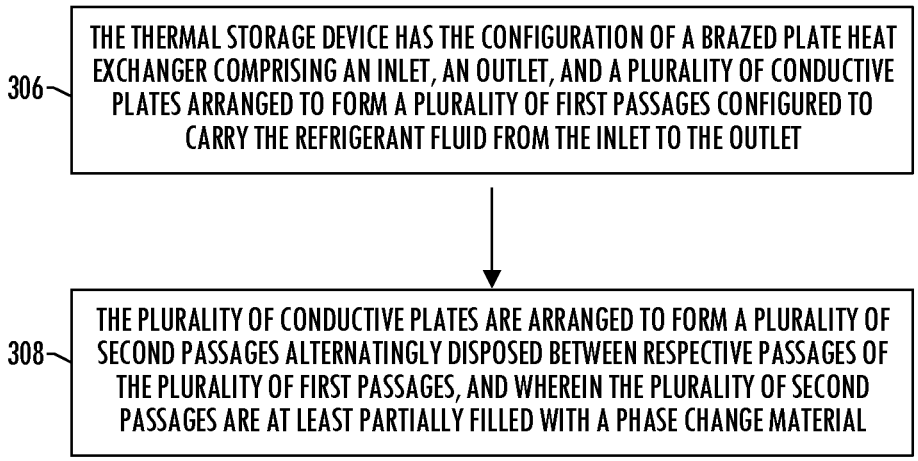

In some examples, the coupling includes selecting the thermal storage device having the configuration of a brazed plate heat exchanger comprising an inlet, an outlet, and a plurality of conductive plates, and further comprising arranging the plurality of conductive plates to form a plurality of first passages configured to carry the refrigerant fluid from the inlet to the outlet, as shown in block 306 of FIG. 4B. In some examples, the method further includes arranging the plurality of conductive plates to form a plurality of second passages alternatingly disposed between respective passages of the plurality of first passages, and wherein the plurality of second passages are at least partially filled with a phase change material, as shown in block 308 of FIG. 4B.

Figure 4C:
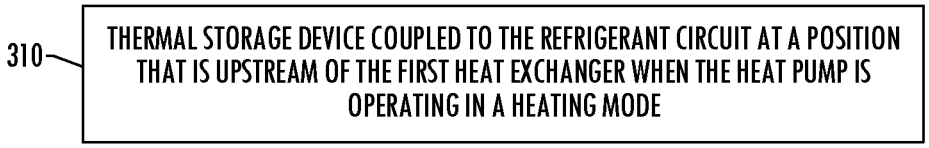

In some examples, the thermal storage device is coupled to the refrigerant circuit at a position that is upstream of the first heat exchanger when the heat pump is operating in a heating mode, as shown in block 310 of FIG. 4C.

Figure 4D:
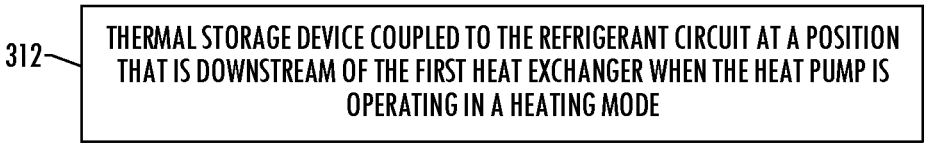

In some examples, the thermal storage device is coupled to the refrigerant circuit at a position that is downstream of the first heat exchanger when the heat pump is operating in a heating mode, as shown in block 312 of FIG. 4D.

Figure 4E:
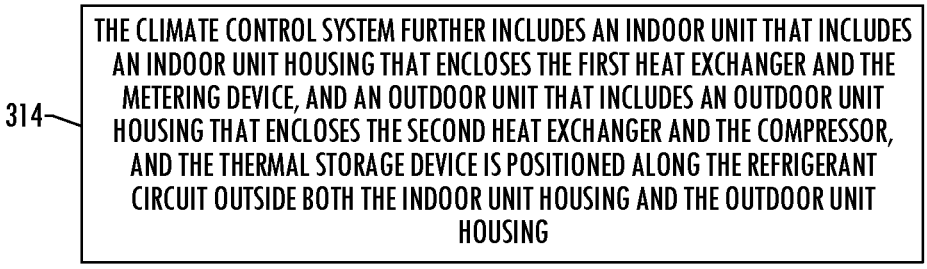

In some examples, the climate control system further includes an indoor unit that includes an indoor unit housing that encloses the first heat exchanger and the metering device, and an outdoor unit that includes an outdoor unit housing that encloses the second heat exchanger and the compressor, and the thermal storage device is positioned along the refrigerant circuit outside both the indoor unit housing and the outdoor unit housing, as shown in block 314 of FIG. 4E.

Figure 4F:
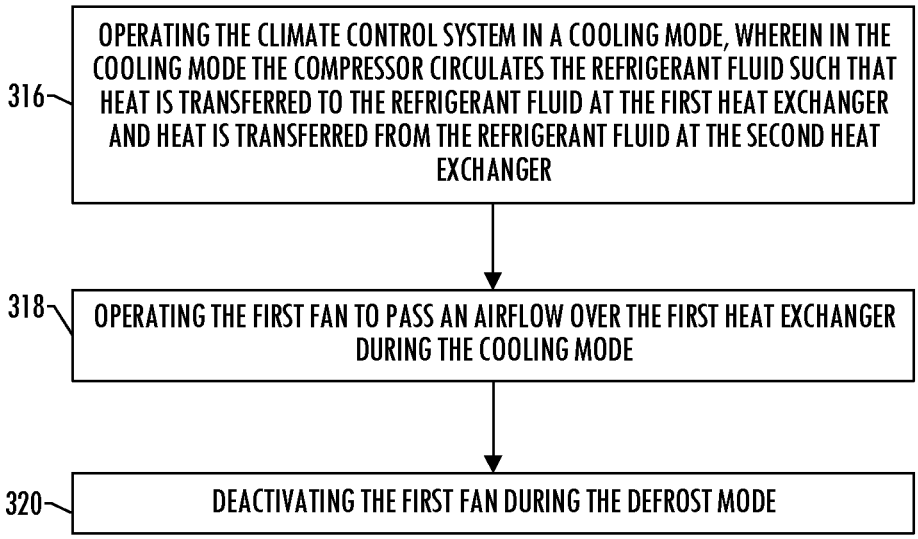

In some examples, the method further includes operating the climate control system in a cooling mode, wherein in the cooling mode the compressor circulates the refrigerant fluid such that heat is transferred to the refrigerant fluid at the first heat exchanger and heat is transferred from the refrigerant fluid at the second heat exchanger, as shown in block 316 of FIG. 4F. The method can also include operating the first fan to pass an airflow over the first heat exchanger during the cooling mode, as shown in block 318 of FIG. 4F. The method can also include deactivating the first fan during the defrost mode, as shown in block 320 of 4F.

Figure 4G:
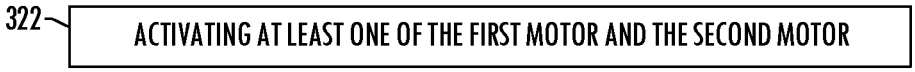

In some examples, the first fan is operably coupled to a first motor, the second fan is operably coupled to a second motor, and the method further comprises activating at least one of the first motor and the second motor, as shown in block 322 of FIG. 4G.

Figure 5:
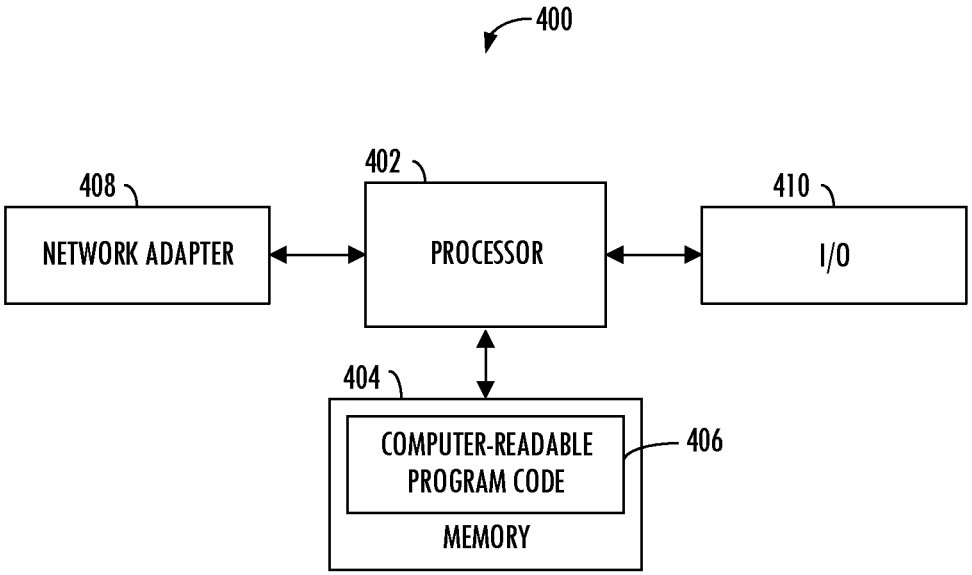
FIG. 5 is an illustration of control circuitry, according to an example embodiment of the present disclosure.

FIG. 5 illustrates the control circuitry 400 according to some example implementations of the present disclosure. The control circuitry may include one or more of each of a number of components such as, for example, a processor 402 connected to a memory 404. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit is at times more commonly referred to as a "chip"). The processor 402 may be a number of processors, a multi-core processor, or some other type of processor, depending on the particular implementation.

The processor 402 may be configured to execute computer programs such as computer-readable program code 406, which may be stored onboard the processor or otherwise stored in the memory 404. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 404 is generally any piece of computer hardware capable of storing information, such as, for example, data, computer-readable program code 406 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein, which, in response to execution by the processor 402, causes the control circuitry 400 to perform various operations as described herein, some of which may in turn cause the HVAC system 100 to perform various operations.

In addition to the memory 404, the processor 402 may also be connected to one or more peripherals such as a network adapter 408, one or more input/output (I/O) devices 410, or the like. The network adapter is a hardware component configured to connect the control circuitry 400 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

Many modifications and other implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific implementations disclosed and that modifications and other implementations are intended to be included within the scope of the appended claims. Moreover, although the foregoing description and the associated figures describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A heat pump comprising:

a compressor, a metering device, a first heat exchanger, and a second heat exchanger;

a refrigerant circuit comprising a refrigerant fluid that circulates between the first heat exchanger and the second heat exchanger;

a first fan configured to produce an airflow, the first fan positioned adjacent the first heat exchanger;

a second fan configured to produce an airflow, the second fan positioned adjacent the second heat exchanger;

a thermal storage device coupled to the refrigerant circuit such that the refrigerant fluid flows therethrough in series with the first and the second heat exchanger, the thermal storage device configured to store thermal energy when the refrigerant fluid flowing therethrough is above a threshold temperature and discharge thermal energy when the refrigerant fluid flowing therethrough is below the threshold temperature; and control circuitry, wherein the control circuitry is configured to:

operate the heat pump in a plurality of modes, the plurality of modes comprising a heating mode and a defrost mode, wherein in the heating mode the compressor circulates the refrigerant fluid such that heat is transferred from the refrigerant fluid at the first heat exchanger and heat is transferred to the refrigerant fluid at the second heat exchanger, and the temperature of the refrigerant fluid at the thermal storage device is above the threshold temperature such that heat from the refrigerant fluid is stored in the thermal storage device;

wherein in the defrost mode the compressor circulates the refrigerant fluid such that heat is transferred to the refrigerant fluid at the first heat exchanger and heat is transferred from the refrigerant fluid at the second heat exchanger, and the temperature of the refrigerant fluid at the thermal storage device is below the threshold temperature such that heat from the thermal storage device is discharged to the refrigerant fluid, wherein in both heating mode and defrost mode the refrigerant fluid flows through the thermal storage device, the first heat exchanger, and the second heat exchanger.

2. The heat pump of claim 1, wherein the thermal storage device is a brazed plate heat exchanger comprising an inlet, an outlet, and a plurality of conductive plates arranged to form a plurality of first passages configured to carry the refrigerant fluid from the inlet to the outlet.

3. The heat pump of claim 2, wherein the plurality of conductive plates is arranged to form a plurality of second passages alternatingly disposed between respective passages of the plurality of first passages, and wherein the plurality of second passages is at least partially filled with a phase change material.

4. The heat pump of claim 1, wherein the thermal storage device is coupled to the refrigerant circuit at a position that is upstream of the first heat exchanger when the heat pump is operating in a heating mode.

5. The heat pump of claim 1, wherein the thermal storage device is coupled to the refrigerant circuit at a position that is downstream from the first heat exchanger when the heat pump is operating in a heating mode.

6. The heat pump of claim 1, wherein the first heat exchanger is received within an enclosure, and the thermal storage device is positioned outside of the enclosure.

7. The heat pump of claim 1, wherein the thermal storage device is a first thermal storage device, and the heat pump further comprises a second thermal storage device, each thermal storage device having a threshold temperature, wherein the threshold temperature of the first thermal storage device is different from the threshold temperature of the second thermal storage device.

8. The heat pump of claim 7, wherein the first thermal storage device is coupled to the refrigerant circuit at a position that is one of upstream and downstream of the first heat exchanger and the second thermal storage device is coupled to the refrigerant circuit at a position that is the other of upstream or downstream of the first heat exchanger.

9. The heat pump of claim 1, wherein the plurality of modes further comprises a cooling mode, wherein, in the cooling mode, the compressor circulates the refrigerant fluid such that heat is transferred to the refrigerant fluid at the first heat exchanger and heat is transferred from the refrigerant fluid at the second exchanger, wherein the control circuitry is further configured to operate the first fan to direct an airflow over the first heat exchanger to a conditioned space during the cooling mode, and to deactivate the first fan during the defrost mode.

10. The heat pump of claim 1, wherein the first fan is operably coupled to a first motor and the second fan is operably coupled to a second motor.

11. A method of operating a climate control system, the climate control system comprising: a compressor, a metering device, a first heat exchanger, a second heat exchanger, a first fan positioned adjacent the first heat exchanger, and a second fan positioned adjacent the second heat exchanger; a refrigerant circuit comprising a refrigerant fluid that circulates between the first heat exchanger and the second heat exchanger, a thermal storage device fluidly coupled to the refrigerant circuit in series with the first and the second heat exchanger and configured to store thermal energy when refrigerant fluid flowing therethrough is above a threshold temperature and discharge thermal energy when refrigerant fluid flowing therethrough is below the threshold temperature, and a controller; the method comprising:

operating the climate control system in a heating mode, wherein in the heating mode the compressor circulates the refrigerant fluid through the first heat exchanger, the second heat exchanger, and the thermal storage device such that heat is transferred from the refrigerant fluid at the first heat exchanger and heat is transferred to the refrigerant fluid at the second heat exchanger, and the temperature of the refrigerant fluid at the thermal storage device is above the threshold temperature such that heat from the refrigerant fluid is stored in the thermal storage device; and operating the climate control system in a defrost mode, wherein in the defrost mode the compressor circulates the refrigerant fluid through the first heat exchanger, the second heat exchanger, and the thermal storage device such that heat is transferred to the refrigerant fluid at the first heat exchanger and heat is transferred from the refrigerant fluid at the second heat exchanger, and the temperature of the refrigerant fluid at the thermal storage device is below the threshold temperature such that heat from the thermal storage device is discharged to the refrigerant fluid.

12. The method of claim 11, wherein the thermal storage device has the configuration of a brazed plate heat exchanger comprising an inlet, an outlet, and a plurality of conductive plates arranged to form a plurality of first passages configured to carry the refrigerant fluid from the inlet to the outlet.

13. The method of claim 12, the plurality of conductive plates are arranged to form a plurality of second passages alternatingly disposed between respective passages of the plurality of first passages, and wherein the plurality of second passages is at least partially filled with a phase change material.

14. The method of claim 11, wherein the thermal storage device is coupled to the refrigerant circuit at a position that is upstream of the first heat exchanger when the heat pump is operating in a heating mode.

15. The method of claim 11, wherein the thermal storage device is coupled to the refrigerant circuit at a position that is downstream from the first heat exchanger when the heat pump is operating in a heating mode.

16. The method of claim 11, wherein the climate control system further comprises an indoor unit that includes an indoor unit housing that encloses the first heat exchanger and the metering device, and an outdoor unit that includes an outdoor unit housing that encloses the second heat exchanger and the compressor, wherein the thermal storage device is positioned along the refrigerant circuit outside both the indoor unit housing and the outdoor unit housing.

17. The method of claim 11, wherein the method further comprises:

operating the climate control system in a cooling mode in which the compressor circulates the refrigerant fluid such that heat is transferred to the refrigerant fluid at the first heat exchanger and such that heat is transferred from the refrigerant fluid at the second heat exchanger;

operating the first fan to pass an airflow over the first heat exchanger during the cooling mode; and deactivating the first fan during the defrost mode.

18. The method of claim 11, wherein the first fan is operably coupled to a first motor, the second fan is operably coupled to a second motor, and the method further comprises activating at least one of the first motor and the second motor.

19. The method of claim 11, wherein the thermal storage device is a first thermal storage device, and the heat pump further comprises a second thermal storage device, each thermal storage device having a threshold temperature, wherein the threshold temperature of the first thermal storage device is different from the threshold temperature of the second thermal storage device.

20. The method of claim 19, wherein the first thermal storage device is coupled to the refrigerant circuit at a position that is one of upstream and downstream of the first heat exchanger and the second thermal storage device is coupled to the refrigerant circuit at a position that is the other of upstream or downstream of the first heat exchanger.

* * * * *